US006293480B1

(12) United States Patent
Tseng

(10) Patent No.: US 6,293,480 B1
(45) Date of Patent: Sep. 25, 2001

(54) STRUCTURE OF GRINDING MEDIUM CONTROLLABLE IN SHAPE AND SPECIFIC GRAVITY

(76) Inventor: Shao-Chien Tseng, No. 130, Sec. 2, Yang-Shin Rd., Yang-Mei 326 Taoyuan (TW)

( * ) Notice: Subject to any disclaimer, the term of this patent is extended or adjusted under 35 U.S.C. 154(b) by 0 days.

(21) Appl. No.: 09/472,766

(22) Filed: Dec. 27, 1999

(51) Int. Cl.[7] ..... B02C 17/14
(52) U.S. Cl. ..... 241/184
(58) Field of Search ..... 241/184

(56) References Cited

U.S. PATENT DOCUMENTS 1,700,667 * 1/1929 Bues ..... 241/184

* cited by examiner

*Primary Examiner*—Allen Ostrager
*Assistant Examiner*—William Hong

(74) *Attorney, Agent, or Firm*—Pro-Techtor Inter-National Services

(57) ABSTRACT

A structure of grinding medium controllable in shape and specific gravity and comprising a housing, a cover, a spring and a core member is disclosed. The housing includes a head and a stem having a central cavity. The spring is fitted over the stem to form cutting blades for grinding/cutting. The spring can be formed into the shape wherein the thread on one side is close while on the other side is open, and the sectional shape of the spring can be various; hence the medium structure can have ideal blade contours in favor of grinding efficiency. The cover engages the cavity of the stem to form a sealed receiving chamber for positioning the spring, and the receiving chamber with a given volume formed between the cavity and the cover receives a core member or keeps empty. Therefore, specific gravity of the structure is under control and approach that of grinding liquid. So that the structure can pend at a suitable position in the grinding liquid, and chance of collision between the structure and the workpieces to be ground increases to increase efficiency of grinding and cutting.

12 Claims, 12 Drawing Sheets

STRUCTURE OF GRINDING MEDIUM CONTROLLABLE IN SHAPE AND SPECIFIC GRAVITY

BACKGROUND OF THE INVENTION

1. Field of the Invention

The present invention is related to a structure of grinding medium controllable in shape and specific gravity, and especially to a structure of grinding medium comprised of a housing, a cover, a spring and a core. The structure is used to precisely control specific gravity of grinding medium, and capable of assembling/changing springs of different sectional shapes and degrees of stretching and retracting. Thereby, the contour of blades on the external surface of the structure of grinding medium can be under control, thus chance and efficiency of grinding of a work piece to be ground can be increased.

2. Description of the Prior Art

The grinding technique using a vibration motor or supersonic-wave vibrating objects to generate multiple dimensional vibration is well known, it includes the steps of selecting desired grinding liquid and grinding granules of suitable diameters, hardness and shapes in accordance with physical characteristics of the workpieces to be ground. The grinding granules used to be made of plastic, stones or ceramic of various hardness and mass. The conventional grinding granules are made with shapes in favor of grinding, to facilitate the mixed grinding granules and grinding liquid to be subjected to desired vibration frequency as well as grinding process of multiple dimensional vibration in a vibration tank.

It is also known that the grinding technique using a vibration motor as a vibrating source to generate multiple dimensional vibration uses a large mount of grinding granules to envelop the workpieces to be ground in a vibration tank. Wherein, the vibration motor makes the vibration tank vibrate to synchronically disturb the grinding granules in the vibration tank to collide the workpieces to be ground and gives grinding and finishing function on the workpieces. Conventionally used grinding granules have larger mass in order to get larger vibrational inertia of the grinding granules for obtaining better grinding and finishing function. However, the grinding granules of larger mass make trouble of accumulation of themselves in the bottom layer of the vibration tank to get the result that the grinding granules are distributed denser in the bottom layer, and looser in the surficial layer. Therefore, chance of collision between the grinding granules and the workpieces to be ground in the surficial layer is lowered. And when in multiple dimensional vibration, the workpieces to be ground can not be uniformly ground, longer grinding time is required to get higher chance of grinding between the grinding granules and the workpieces to be ground. This is why efficiency of grinding thereof is inferior.

Further, the vibration technique using supersonic-wave objects as the source of multiple dimensional vibration generates supersonic waves to obtain consonant vibration of grinding liquid and a vibration tank and to make the grinding liquid form oscillating water flow of high frequency. The water flow makes the grinding granules vibrate to synchronically oscillate to collide the workpieces to be ground and gives grinding and finishing function on the workpieces. However, specific gravity of conventional grinding granules is determined by the mass and volume of their own and hard to control to approach that of the grinding liquid. This makes the grinding granules concentrate at the surface of the grinding liquid or the bottom of a vibration tank. The suitable pending position of the grinding granules is hard to control; therefore, chance of collision between the grinding granules and the workpieces to be ground is lowered. Hence, longer grinding time or higher supersonic wave frequency is required to increase chance of collision; the fact that grinding efficiency is inferior is evident.

And more, shapes of conventional grinding granules are certain and simple, they are lack of variety in favor of grinding. Therefore, when every grinding granule makes multiple dimensional vibration on the workplaces to be ground, grinding operation will be hindered by limited cutting points. This is the defect of the conventional grinding granules.

And the above stated problems to be solved are the motive of the present invention.

SUMMARY OF THE INVENTION

The object of the present invention is to provide a grinding medium structure which can be effectively adjusted and controlled in its unit specific gravity and exterior contour to thereby increase efficiency of processing.

To achieve the object, in practice, a housing including a head and a stem can be used; the stem has a cavity. The cavity is provided at the opening thereof with an engaging recess for engagement with a cover which includes a head and a lower edge. A spring is provided over the stem, then the lower edge of the cover is engaged with the engaging recess of the housing, thereby, the housing, the spring and the cover can be tightly combined with one another. The cavity of the housing thus forms a receiving chamber together with the cover. In this way, the structure of grinding medium is completed.

Wherein, the receiving chamber can be empty or loaded with gas, liquid or solid core member to render it to have a characteristic of ability of changing gross mass of the grinding medium. The volume of the structure of grinding medium is constant; therefore, by adjusting and controlling gross mass of the grinding medium after obtaining the unit volume of the grinding medium, the desired specific gravity of the grinding medium structure can be secured.

The abovementioned adjusting and controlling of the desired specific gravity of the grinding medium structure is determined according to the specific gravity used for the grinding liquid in grinding. I.e., in principle, the specific gravity of the grinding medium structure is preferably adjusted and controlled to be close to that of the grinding liquid. So that a pending layer of the grinding granules in the grinding liquid can be obtained to render the grinding granules more easily be moved by the grinding liquid, thus chance of collision and grinding between the grinding granules and the workpieces to be ground can be increased and in turn grinding efficiency can be increased.

The abovementioned spring can be a stretchable or compressible helical spring, and the material and sectional shape thereof can be chosen to form cutting blades on the exterior periphery of the medium structure, in order to be coincident with the material and contour of the workpieces to be ground. Therefore, forceful scraping-grinding or softer grinding and finishing can be used in pursuance of the environment of working.

The present invention will be apparent after reading the detailed description of the preferred embodiment thereof in reference to the accompanying drawings.

DETAILED DESCRIPTION OF THE PREFERRED EMBODIMENT

Figure 1:
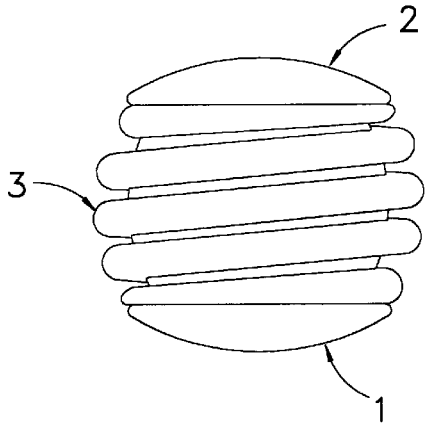
FIG. 1 is a perspective view of the present invention.

Referring to FIG. 1, the structure of grinding medium of the present invention is comprised mainly of a housing 1, a cover 2 and a spring 3.

Figure 2:
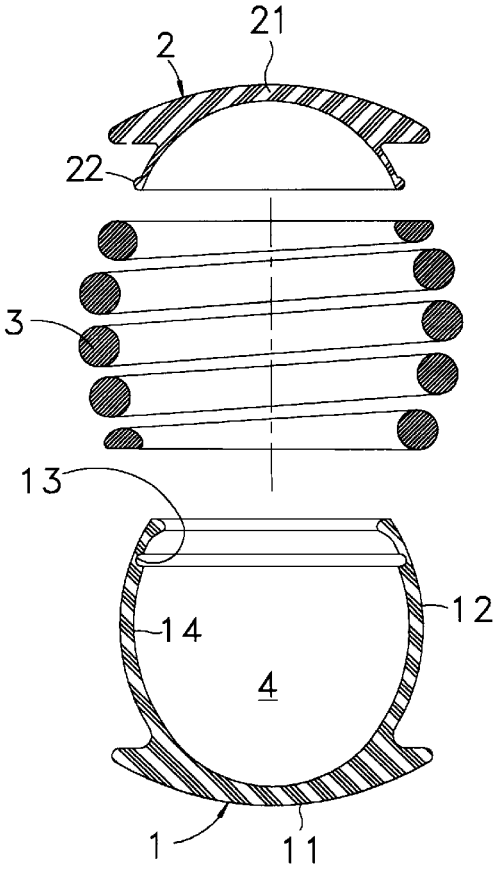
FIG. 2 is an analytic sectional view of the present invention.

Wherein, material of the housing 1 is chosen from suitable plastic or metal. The housing 1 includes a head 11 and a stem 12 which has a central cavity 14. The cavity 14 is provided at the opening thereof with an engaging recess 13 in the form as depicted in FIG. 2. Diameter of the peripheral edge of the head 11 of the housing 1 is slightly smaller than that of the spring 3 to make exposure of the spring 3. The engaging recess 13 is used to connect the cover 2.

The cover 2 is also made of suitable plastic or metal and includes a head 21 and a lower edge 22 (referring to FIG. 2). Diameter of the peripheral edge of the head 21 is slightly smaller than that of the spring to make exposure of the spring 3 too. The lower edge 22 of the cover 2 can be engaged with the engaging recess 13 of the housing 1. Thereby the cavity 14 of the housing 1 forms an isolated and sealed receiving chamber 4 together with the cover 2 (also referring to FIG. 3).

Figure 4:
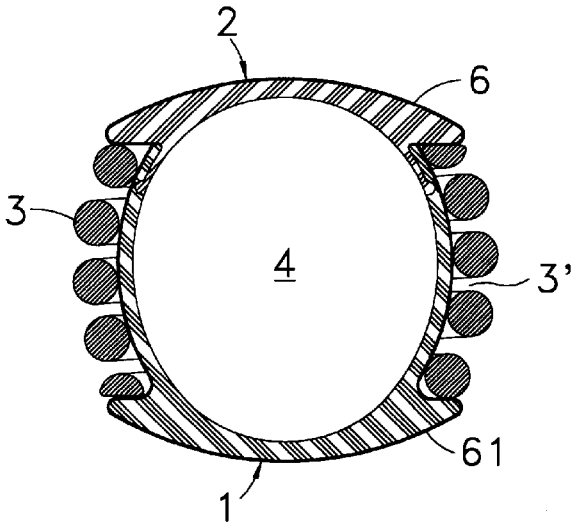
FIG. 4 is a sectional view of another embodiment of the present invention having the surfaces of its housing and cover applied with a coating.

When the housing 1 and the cover 2 are made of material being more easily eroded and abraded, they can be coated on the surfaces thereof each with an abrasion resistive coating 6 (61) (also referring to FIG. 4). The coatings 6, 61 can be made of erosion and abrasion resistive material such as Teflon, chromium, molybdenum or ceramic etc. Hence hardness and abrasion resistance of the surfaces of the housing 1 and the cover 2 can be increased, and the surface of the head 11 of the housing 1 and the head 21 of the cover 2 can have the additional function of rotation grinding and finishing on the workpieces to be ground. Therefore, grinding efficiency and life of use of the housing 1 and the cover 2 can be increased.

Adding of coatings stated above can also be used on the spring 3. When the surface of the spring 3 is added with a coating, abrasion resistance and coarseness of the surface of the spring 3 can be increased to improve operation of heavy grinding and cutting process.

Figure 3:
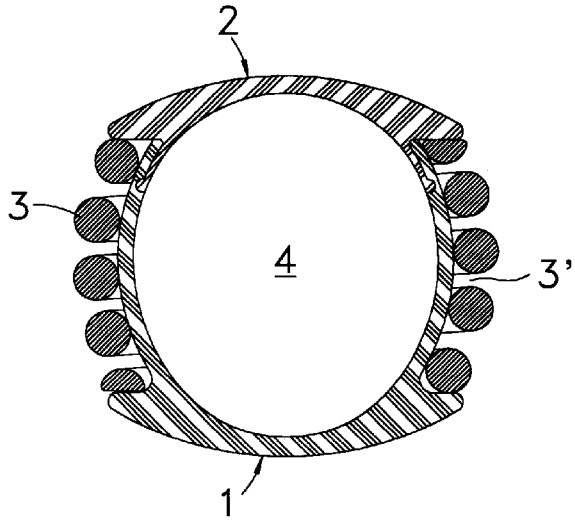
FIG. 3 is a sectional view of an embodiment of the present invention.
Figure 5:
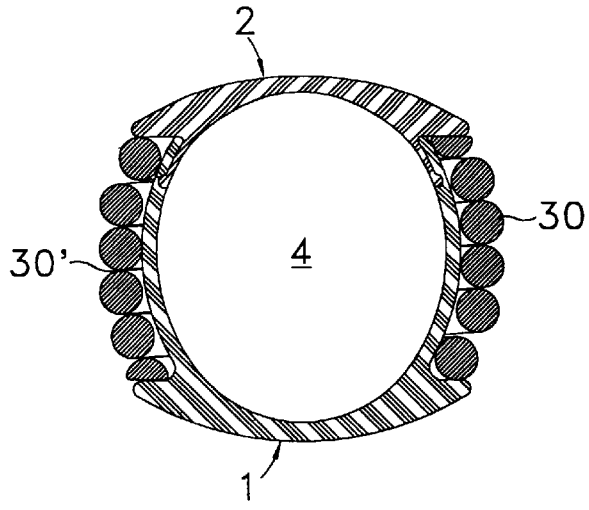
FIG. 5 is a sectional view of a spring of the present invention.

The helical spring mentioned above can be the compressible spring 3 (referring to FIG. 3, 4) or a stretchable spring 30 (referring to FIG. 5). In which, when the compressible spring 3 is assembled, every two neighboring thread sections of the spring shank form therebetween a cutting mouth 3' of larger gap (as shown in FIG. 3); while when the stretchable spring 30 is assembled, every two neighboring sections of the spring shank form therebetween a cutting mouth 30' of smaller gap (as shown in FIG. 5). These can be chosen depending on practical requirement of grinding and cutting by a user.

Figure 6:
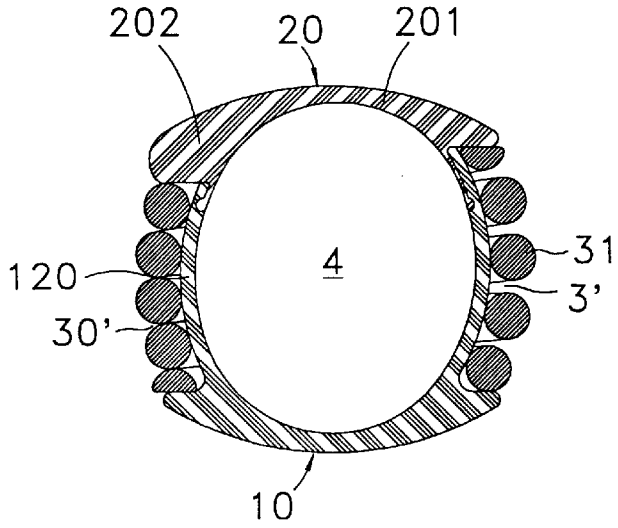
FIG. 6 is a sectional view of another spring of the present invention.

Referring to FIG. 6, the present invention can also have a lower edge 202 of the head 201 of a cover 20 made as an-unsymmetrical and gradually bevel surface (as shown in FIG. 6). So that a spring 31 is pressed over a stem 120, this forms between every two neighboring thread sections of the spring shank larger cutting mouths 3' which are gradually reduced toward the opposite smaller cutting mouths 30' around the spring 31.

The way of providing the spring with larger and smaller cutting mouths can also be done by integrally forming the helical spring into the shape wherein the thread on one side is tightly close while on the other side is loosely open without changing the shape of the head thereof. So that when it is fitted over the stem, the same mode results, that is, such operation forms between every two neighboring thread sections of the spring shank larger cutting mouths 3' which are gradually reduced toward the opposite smaller cutting mouths 30'. And these all fall into the scope of the present invention.

Figure 7:
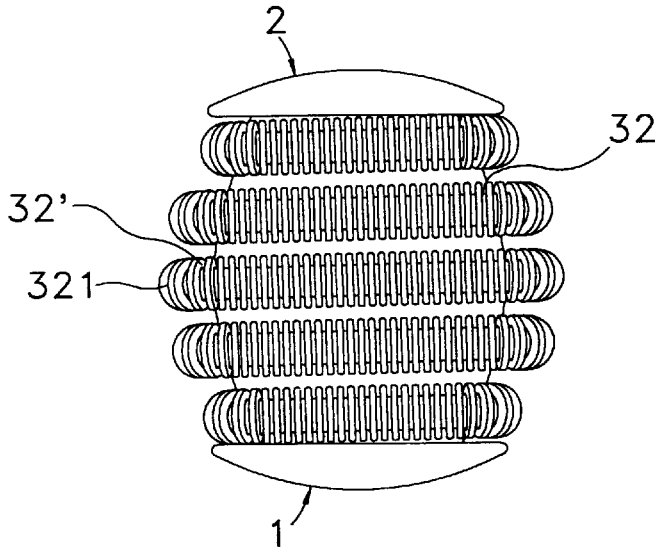
FIG. 7 is a perspective view of another embodiment of the present invention.
Figure 8:
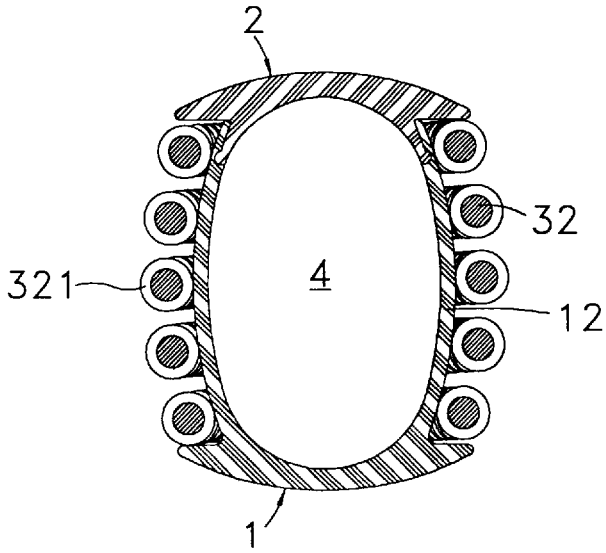
FIG. 8 is a sectional view taken from FIG. 7.

In the present invention, a composite spring can be fitted over the stem 12 (as shown in FIG. 7 and 8), wherein, a fine spring 321 is fitted over a medium coarse spring 32. In this way, orientations of the exposed thread can be varied and distribution of the cutting mouths can be finer. This is benefit to requirement of flow direction changing of disturbing water flow in grinding liquid for fine grinding and cutting or for multiple-dimension vibration.

Figure 9:
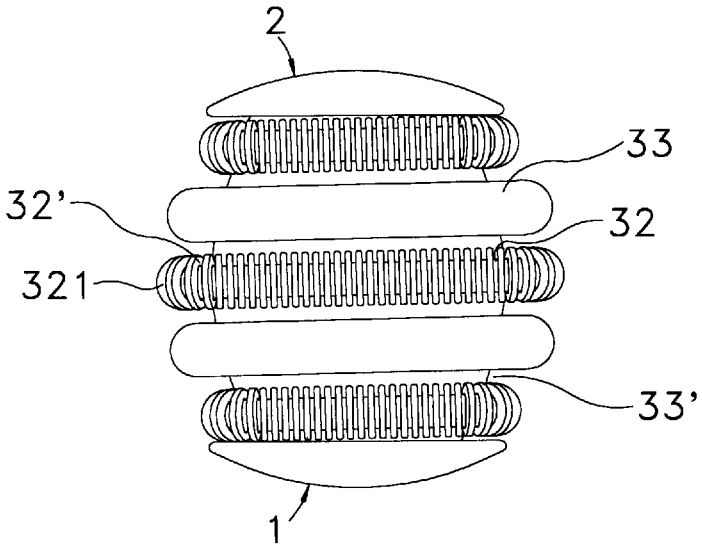
FIG. 9 is a perspective view of another embodiment relative to FIG. 7 of the present invention.
Figure 10:
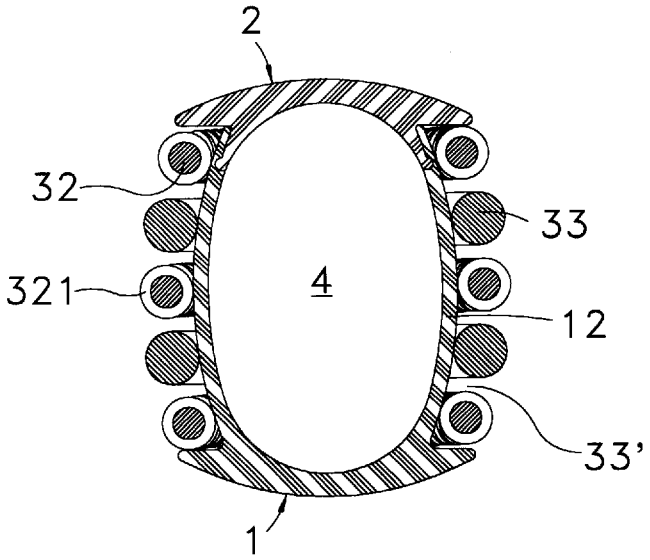
FIG. 10 is a sectional view taken from FIG. 9.

The abovementioned medium coarse spring 32 can be assembled with a coarse spring 33 as an alternative mode in use (also referring to FIG. 9 and 10). The medium structure can thus simultaneously be provided with longitudinal fine cutting mouths 32' and transverse larger cutting mouths 33' formed between the coarse spring 33 and the fine spring 321 to obtain a mode having the larger and smaller and alternately arranged cutting mouths. This is most helpful to combined grinding, cutting and finishing processes on workpieces to be ground with ununiform coarse surfaces.

Figure 11:
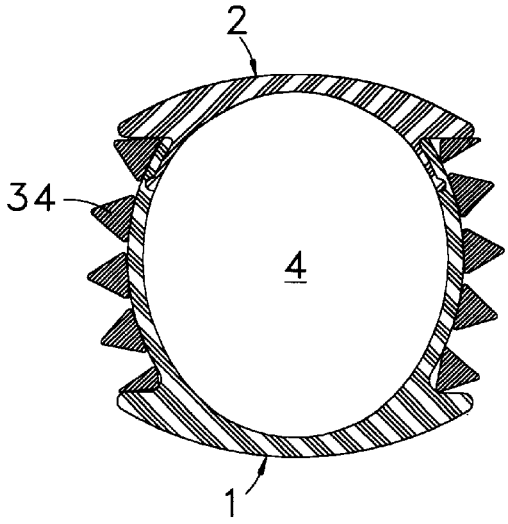
FIG. 11 is a sectional view of another spring of the present invention.
Figure 12:
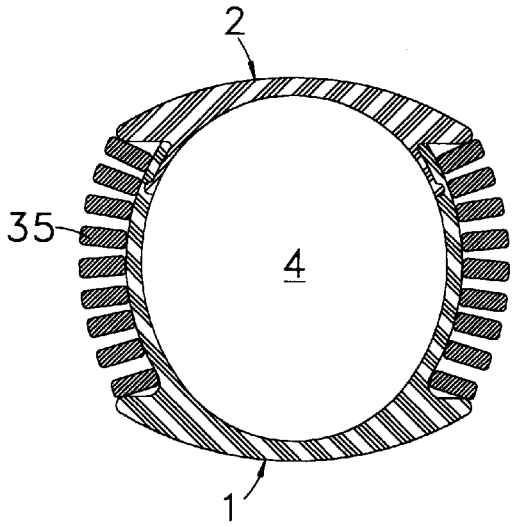
FIG. 12 is a sectional view of a further spring of the present invention.

And more, in the present invention, the medium structure can also be constructed with helical springs of different sectional shapes to suit light or heavy grinding and cutting or grinding and finishing. For example, choosing a spring 31 with a round section (as shown in FIG. 6) is more suitable for soft grinding and finishing process in fine grinding; and choosing a spring 34 with a triangular section (as shown in FIG. 11) can increase planing ability on the coarse coarse surfaces of the workpieces to be ground with the exposed sharper triangular blades; further choosing a spring 35 with a rectangular section (as shown in FIG. 12) can increase stiffness of the spring 35 and suitable for abrading the surficial coarse surfaces of the workplaces to be ground with the thicker blades such as in heavy grinding and cutting situation.

The abovementioned receiving chamber 4 can also be loaded with a stable and light inert gas such as helium or hydrogen to render the medium structure lighter; and can be loaded with liquid such as water or agent of very different specific gravity in order to get the desired gross mass of the medium structure. Besides, the receiving chamber 4 can also be used for loading of a core member 5.

Figure 13:
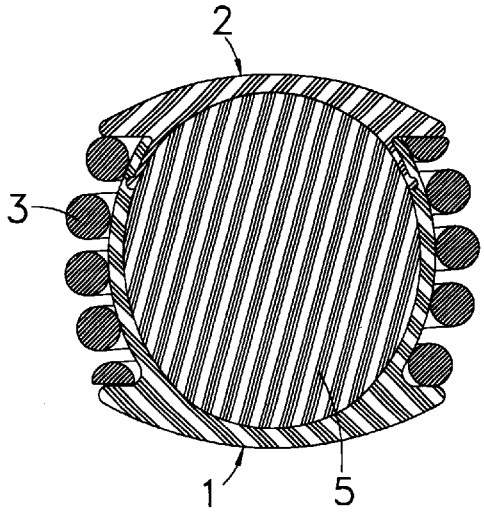
FIG. 13 is a sectional view of a solid core member of the present invention.
Figure 14:
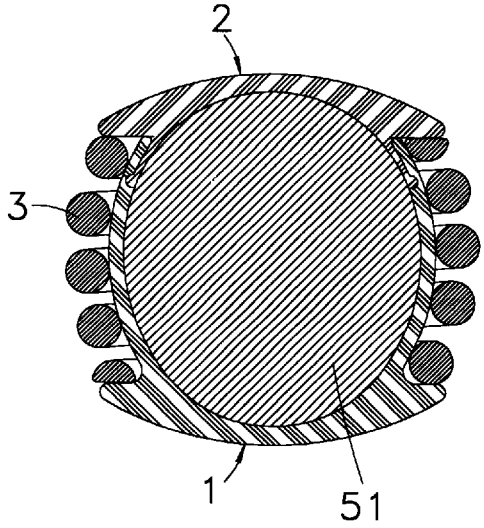
FIG. 14 is a sectional view of another solid core member of the present invention.
Figure 15:
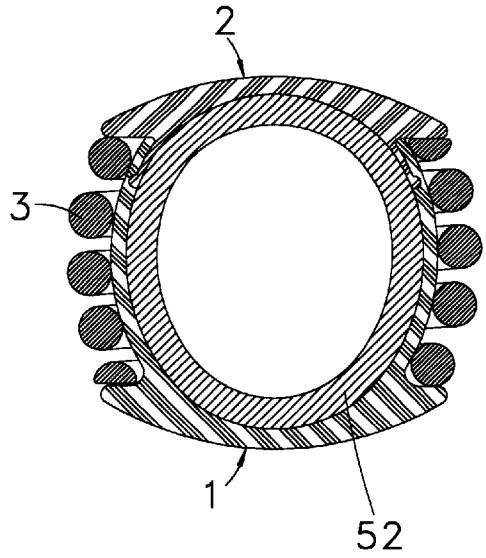
FIG. 15 is a sectional view of a hollow core member of the present invention.

The core member 5 can be chosen as a solid core member 5 made of plastic (as shown in FIG. 13), or as a solid core member 51 made of metal (as shown in FIG. 14). It can of course be chosen as a hollow core member 52 (as shown in FIG. 15) to be loaded in the receiving chamber 4. Therefore, the core member can have multiple variations in mass and material choosing, and these all fall into the scope of the present invention.

Figure 16:
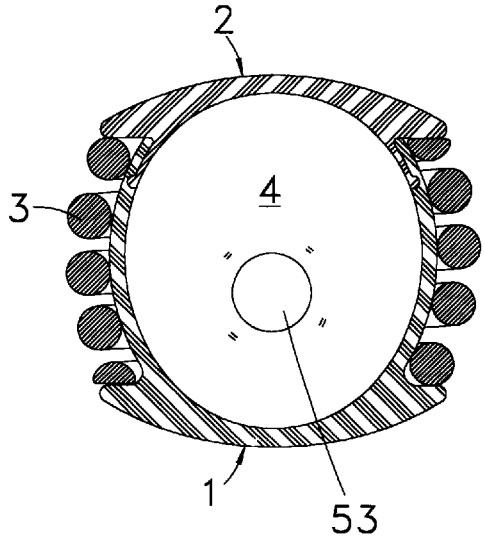
FIG. 16 is a sectional view of a counter balance weight as the core member of the present invention.

The receiving chamber 4 can also be loaded with a counter balance weight 53 as a core member and having a volume smaller than that of the receiving chamber 4 (referring to FIG. 16). Due to the smaller volume, the counter balance weight 53 can rotate freely in the receiving chamber 4, especially when the medium structure is moved by the grinding liquid to collide with the workpieces to be ground, the counter balance weight 53 can be increased in grinding and cutting ability by increasing grinding and cutting energy of the medium structure in colliding the workpieces to be ground by virtue of the inertia force thereof. It is certain that the counter balance weight 53 can be chosen as a lighter plastic or heavier ceramic or metallic solid or hollow one for making the mass be under control, and these all fall into the scope of the present invention.

Figure 17:
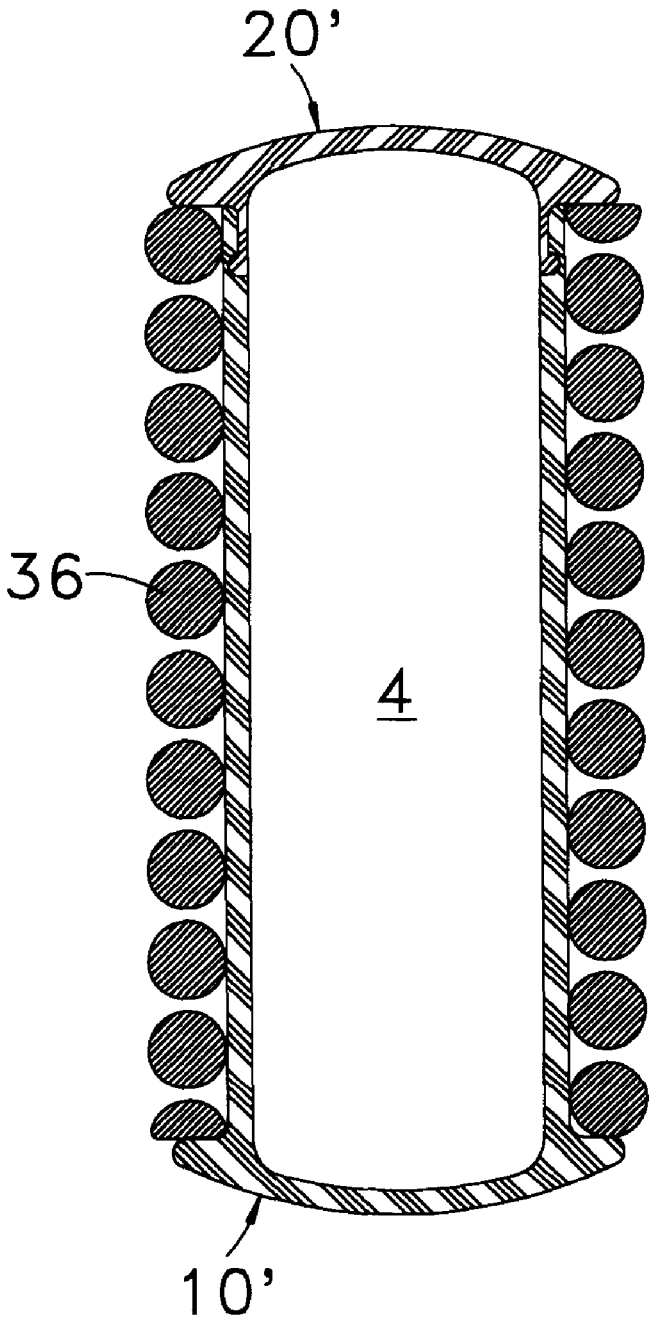
FIG. 17 is a sectional view of another group of housing and cover of the present invention.

If the workpieces to be ground has an irregular contour, the housing 1 and the cover 2 can cooperate mutually complementarily to form any assemblable and sealed style. The spring 3 can also be made in matching with the stem 12 of the housing 1, so that the grinding medium structure can have its contour changed in pursuance of the degree of complication of the workpieces to be ground. For example, combination of a housing 10' and a cover 20' forms a column (as shown in FIG. 17), this renders the area of grinding and cutting of a spring 36 larger, and is helpful to the workplaces to be ground such as a ground pipe surface or bore surface. Thus applicability thereof is increased.

Figure 18:
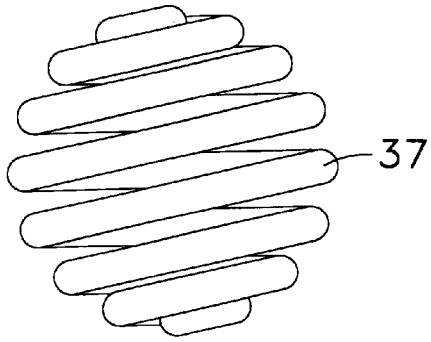
FIG. 18 is a perspective view of another embodiment of the present invention.
Figure 19:
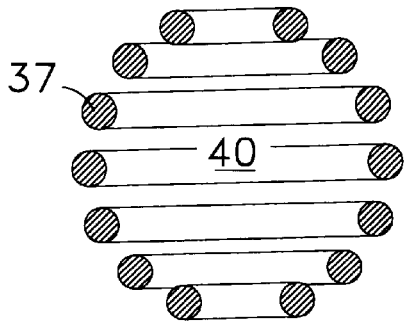
FIG. 19 is a sectional view taken from FIG. 17.

The grinding medium structure of the present invention can have the housing 1 and the cover 2 saved and only uses a wrapping spring 37 to form a ball shaped medium structure (as shown in FIG. 18). The spring 37 is formed centrally thereof a receiving chamber 40 (referring to FIG. 19), thus another embodiment of the present invention is formed. This renders the medium structure to be effectively reduced to have a smaller volume. Therefore, the medium structure of the present invention can be more widely applied on more delicate workpieces to be ground such as frames of spectacles, housings of watches, and parts of machining etc. The surficial layer of the spring 37 can be the abovementioned coating; in this mode, abrasion resistance and surficial coarseness of the spring 37 can be increased to promote heavy grinding and cutting.

Figure 20:
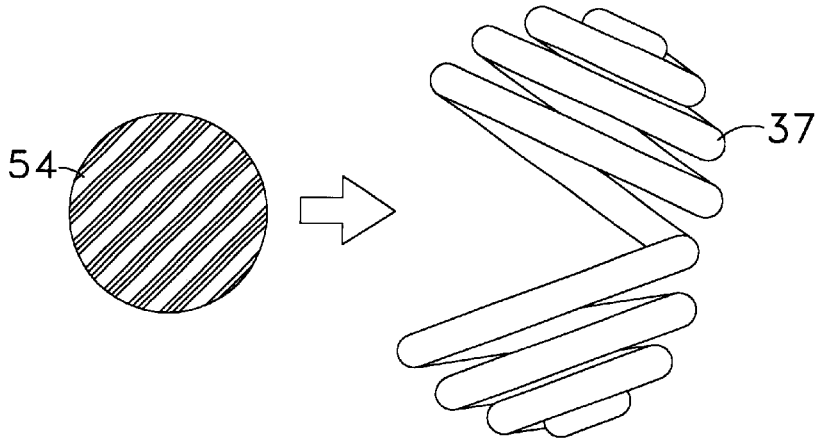
FIG. 20 is a schematic view of another embodiment of the present invention with a core member.
Figure 21:
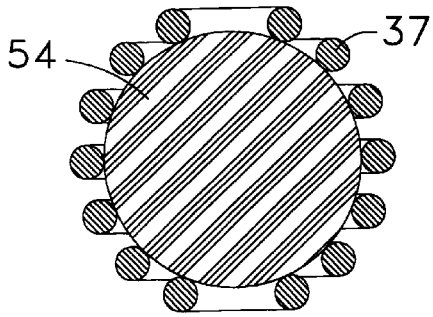
FIG. 21 is a sectional view taken from FIG. 20.

The aforesaid spring can be easily separated to make an opening in order to conveniently place a core member 54 in the receiving chamber 40 (as shown in FIG. 20). So that specific weight of the medium structure can be easily controlled with the core member 54 and is applicable in various grinding situation. The core member 54 can be made, according to the requirement of mass thereof and as is the case stated above, of plastic to be a solid core member 54 (referring to FIG. 21) or of wood, metal or ceramic to be a solid or hollow type. Thereby, the core member 54 can have multiple variations in mass and material choosing, and these all fall into the scope of the present invention.

Figure 22:
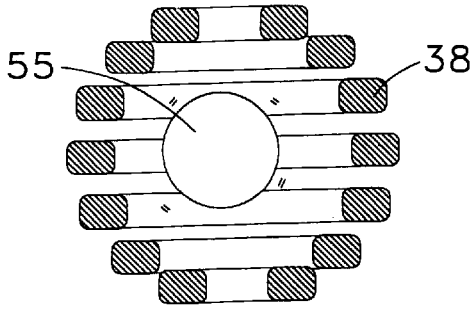
FIG. 22 is a sectional view of another embodiment of the present invention with another core member.

Shape of the section of the aforesaid spring and choosing of the core member can be done depending on the feature of the workplaces to be ground. As shown in FIG. 22, the cross section of a spring 38 is chosen to be rectangular, and a core member 55 in the form of a counter balance weight with a volume smaller than that of the receiving chamber 40 is chosen as another embodiment of core member. So that stiffness of the medium structure is strengthened by the rectangular section shape of the spring 38. Accelerative oscillating of the core member 55 can further promote abrading of rough surfaces with the thickened corners or teeth of the spring 38 easily and fast. And this is more suitable for light grinding and cutting delicate parts.

Figure 23:
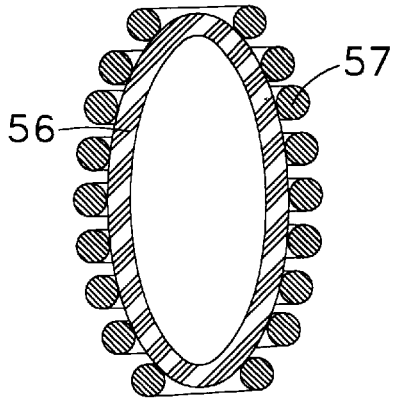
FIG. 23 is a sectional view of another embodiment of the present invention with another spring.

When the contour of the workpieces to be ground is irregular, a spring can also be used in processing the workpieces together with a core member to allow the medium structure to change its shape in pursuance of the shapes of the workpieces and thereby suiting various workplaces to be ground. For example, a spring 57 with a core member 56 therein in the shape of an oval (referring to FIG. 23) is used to increase the area of grinding and cutting that the spring 57 can work. This is helpful to grinding delicate pipe surfaces or bore surfaces of the workpieces to be ground, and enlarge applicability of the medium structure.

In conclusion, the structure of grinding medium controllable in shape and specific gravity of the present invention has the characteristic that the core member 5 in the receiving chamber 4 can control the mass of the medium to render the specific gravity of the structure of grinding medium to approximate to that of the grinding liquid, so that the structure of grinding medium can pend at a specific suitable position in the grinding liquid. And chance of collision between the grinding medium and the workpieces to be ground can be effectively increase. Further, cutting points and their areas in grinding and cutting on the surfaces of the workpieces to be ground can be increased to increase efficiency of grinding and cutting. And more, by the characteristics of the housing 1 and the cover 2 and the spring 3, the structure of grinding medium can be applicable to multiple workpieces to be ground to suitably grind by rotating and cut to finish the workpieces. The structure stated above hence has novelty, practicality and improvement in increasing efficiency of processing and applicability to multiple workplaces to be ground.

Having thus described my invention, what I claim as new and desire to be secured by Letters Patent of the United States are:

1. A structure of grinding medium controllable in shape and specific gravity, comprised of a housing, a cover, a spring and a core member, wherein, said housing and cover are combined with each other to receive said core member, and said spring is a helical spring; wherein said housing includes a head and a stem which has a central cavity, an opening of said cavity is provided to engage said cover;

said cover includes a head and a lower edge, said lower edge of said cover engages said opening of said cavity of said housing to form a sealed receiving chamber, and said spring is slipped over said stem and thus is sandwiched between said cover and said head of said housing.

2. The structure of grinding medium controllable in shape and specific gravity as claimed in claim 1, wherein, a diameter of said stem of said housing and of said lower edge of said cover both are slightly smaller than that of said spring.

3. The structure of grinding medium controllable in shape and specific gravity as claimed in claim 1, wherein, when said spring is assembled, cutting mouths are formed with gaps for grinding and cutting.

4. The structure of grinding medium controllable in shape and specific gravity as claimed in claim 1, wherein, said helical spring is a composite spring, said composite spring comprising a fine spring fitted over a medium coarse spring, said fine spring forms with said medium coarse spring flared grinding and cutting teeth.

5. The structure of grinding medium controllable in shape and specific gravity as claimed in claim 1, wherein, a coarse spring and a composite spring comprised of a medium coarse spring and a fine spring are alternately wrapped about said stem of said housing, said fine spring forms on said medium coarse spring flared grinding and cutting teeth, such that said composite spring is provided thereon with alternating longitudinal cutting mouths and transverse cutting mouths.

6. The structure of grinding medium controllable in shape and specific gravity as claimed in claim 1, wherein, said receiving chamber receives therein a core member with a small volume to allow said core member to move freely in said receiving chamber.

7. The structure of grinding medium controllable in shape and specific gravity as claimed in claim 1, wherein, said spring is made of plastic.

8. The structure of grinding medium controllable in shape and specific gravity as claimed in claim 1, wherein, said spring is made of metal.

9. The structure of grinding medium controllable in shape and specific gravity as claimed in claim 1, wherein, said spring has a round section such that said structure is suitable for rotational grinding and finishing as well as soft and heavy grinding and cutting.

10. The structure of grinding medium controllable in shape and specific gravity as claimed in claim 1, wherein, said spring has a section with sharp angles such that said structure is suitable for rotational grinding and finishing as well as soft and heavy grinding and cutting.

11. The structure of grinding medium controllable in shape and specific gravity as claimed in claim 1, wherein, said core member is solid.

12. The structure of grinding medium controllable in shape and specific gravity as claimed in claim 1, wherein, said core member is hollow.

* * * * *